US012011026B2

(12) United States Patent
Plattner et al.

(10) Patent No.: US 12,011,026 B2
(45) Date of Patent: Jun. 18, 2024

(54) ELECTRONIC SMOKING DEVICE, DISPENSER, SMOKING SYSTEM AND METHOD OF SUPPLYING A TOBACCO MOUSSE FORMULATION

(71) Applicant: JT International S.A., Geneva (CH)

(72) Inventors: Michael Plattner, Trier (DE); Ryo Kitaoka, Tokyo (JP); Thomas Johaentges, Schweich (DE)

(73) Assignee: JT International S.A. (CH)

( * ) Notice: Subject to any disclaimer, the term of this patent is extended or adjusted under 35 U.S.C. 154(b) by 722 days.

(21) Appl. No.: 17/059,753

(22) PCT Filed: May 29, 2019

(86) PCT No.: PCT/EP2019/064033
§ 371 (c)(1),
(2) Date: Nov. 30, 2020

(87) PCT Pub. No.: WO2020/001913
PCT Pub. Date: Jan. 2, 2020

(65) Prior Publication Data

US 2021/0315256 A1 Oct. 14, 2021

(30) Foreign Application Priority Data

Jun. 28, 2018 (EP) ..... 18180532

(51) Int. Cl.
*A24F 40/10* (2020.01)
*A24B 15/12* (2006.01)
(Continued)

(52) U.S. Cl.
CPC ..... *A24B 15/12* (2013.01); *A24B 15/167* (2016.11); *A24F 40/42* (2020.01); *A24F 40/46* (2020.01); *A24F 40/485* (2020.01); *A24F 40/10* (2020.01)

(58) Field of Classification Search
None
See application file for complete search history.

(56) References Cited

U.S. PATENT DOCUMENTS 4,002,178 A 1/1977 Fiore et al.
4,510,950 A 4/1985 Keritsis et al.
(Continued)

FOREIGN PATENT DOCUMENTS

AU 721146 B2 6/2000
CN 1127983 A * 7/1996 ..... A24F 47/008
(Continued)

OTHER PUBLICATIONS

International Search Report including Written Opinion for PCT/EP2019/064033 dated Dec. 18, 2019; 25 pages.
(Continued)

*Primary Examiner* — Tho D Ta
(74) *Attorney, Agent, or Firm* — Lerner David LLP

(57) ABSTRACT

An electronic smoking device, a dispenser, a smoking system, and a method of supplying a tobacco mousse formulation are provided. The electronic smoking device has an access port configured to receive a tobacco mousse formulation into the electronic smoking device. The dispenser includes a dispensing member configured to dispense a tobacco mousse formulation, in particular into the electronic smoking device.

16 Claims, 4 Drawing Sheets

(51) Int. Cl.

| | |
|---|---|
| ***A24B 15/167*** | (2020.01) |
| ***A24F 40/42*** | (2020.01) |
| ***A24F 40/46*** | (2020.01) |
| ***A24F 40/485*** | (2020.01) |

(56) References Cited

U.S. PATENT DOCUMENTS

| | | | | |
|---|---|---|---|---|
| 5,249,586 | A | 10/1993 | Morgan et al. | |
| 7,500,485 | B1 | 3/2009 | Shepard et al. | |
| 8,366,849 | B2 * | 2/2013 | Buchi | E04H 7/18 220/4.12 |
| 2011/0088708 | A1 | 4/2011 | John et al. | |
| 2015/0114409 | A1 * | 4/2015 | Brammer | A24F 40/44 392/394 |
| 2016/0286851 | A1 | 10/2016 | Hufnagel et al. | |
| 2017/0135398 | A1 | 5/2017 | Scott et al. | |
| 2018/0044162 | A1 * | 2/2018 | Scott | A24F 40/00 |
| 2019/0343168 | A1 | 11/2019 | Plattner et al. | |
| 2021/0282448 | A1 | 9/2021 | Plattner et al. | |

FOREIGN PATENT DOCUMENTS

| | | | |
|---|---|---|---|
| EP | 1677632 | B1 | 12/2009 |
| EP | 2316286 | A1 | 5/2011 |
| EP | 2327318 | A1 | 6/2011 |
| GB | 1013303 | A | 12/1965 |
| JP | 2007-508835 | A | 4/2007 |
| WO | 2013034460 | A1 | 3/2013 |
| WO | 2014083333 | A1 | 6/2014 |
| WO | 2015165813 | A1 | 11/2015 |
| WO | 2016128562 | A1 | 8/2016 |
| WO | 2018019578 | A1 | 2/2018 |

OTHER PUBLICATIONS

Alx FT: "DIY E-Liquid Injection Syringe (100ml)", Feb. 20, 2016 (Feb. 20, 2016), p. 1, XP054979152, Retrieved from the Internet: URL:https://www.youtube.com/watch?v=WIr1Z6C7eBE [retrieved on Feb. 20, 2019] the whole document.

Anonymous: "Dispensing bottles with a manual pump?, E-Cigarette Forum", May 20, 2016 (May 20, 2016), XP055558831, Retrieved from the Internet: URL:https://www.e-cigarette-forum.com/threads/dispensing-bottles-with-a-manual-pump.743423/ [retrieved on Feb. 19, 2019] the whole document.

International Search Report and Written Opinion for PCT/EP2017/084812, dated Apr. 12, 2018.

Definition of kit, Merriam-Webster Dictionary, no date, [online], retrieved from the Internet, [retrieved Aug. 27, 2021], <URL: https:// www .merriam-webster.com/dictionary/kit> (Year: 2021).

International Search Report including Written Opinion for PCT/EP2019/067335 dated Sep. 13, 2019; 17 pages.

* cited by examiner

ELECTRONIC SMOKING DEVICE, DISPENSER, SMOKING SYSTEM AND METHOD OF SUPPLYING A TOBACCO MOUSSE FORMULATION

CROSS-REFERENCE TO RELATED APPLICATIONS

The present application is a national phase entry under 35 U.S.C. § 371 of International Application No. PCT/EP2019/064033, filed May 29, 2019, published in English, which claims priority to European Application No. 18180532.6 filed Jun. 28, 2018, the disclosures of which are incorporated herein by reference.

FIELD OF THE INVENTION

The present invention relates to an electronic smoking device, a dispenser, a smoking system, a method of supplying a tobacco mousse formulation and a tobacco mousse formulation.

BACKGROUND ART

Foamed tobacco products have been known in the prior art mainly in the field of reconstituted tobacco products. Manufacturing processes usually involve forming reconstituted tobacco sheets out of finely ground tobacco particles with a foam forming and a foam stabilizing agent, followed by shredding the reconstituted sheets, and blending with natural tobacco shreds. Generally in such cases a highly hydrated foam or slurry containing over 50% water by weight is formed initially and then the foam or slurry is dried to remove most of the water. For this reason the amount of non-water humectant (e.g. propylene glycol or glycerol) is generally kept low because such humectants are generally hydrophilic and tend to make the drying process more difficult if they are used in any great quantities. The reconstituted tobacco products are usually used for the manufacture of conventional cigarettes, for which an aerosol is delivered by combustion and in which moderate quantities of moisture in the form of water are beneficial in improving the quality of the inhalable aerosol formed by combustion.

The spread and popularity of electronic cigarettes (e-cigarettes) came with the need and possibility for novel tobacco products. E-cigarettes usually generate an aerosol by heating a liquid comprising an aerosol forming agent, water, and optionally additional flavoring and nicotine. The term "electronic smoking device" is used herein as comprising all sorts of electronic devices that are used to replace, or emulate, the experience of smoking a tobacco product. For example, electronic smoking devices include electronic cigarettes, electronic pipes, electronic hookahs, and so on.

Overall, generating the aerosol by heating a liquid may lead to an uneven smoking profile, wherein the experienced flavor of puffs can differ significantly, e.g. by an inefficient extraction of key compounds in the liquid.

One object of the present invention is to provide a product that can provide a more homogeneous evaporation profile, thereby providing a smoker with an even smoking profile.

SUMMARY OF THE INVENTION

The inventors have found that an aerosol containing a tobacco ingredient containing agent and/or an inhalable agent can be more homogeneously released from a foam wherein an aerosol forming agent is contained. Such a foam will herein be called a "tobacco mousse formulation", a "tobacco foam formulation" or a "tobacco foam preparation".

The tobacco mousse formulation, or tobacco foam formulation, discussed herein may comprise a tobacco ingredient containing agent (e.g. tobacco particles), an aerosol forming agent (e.g. propylene glycol, PG, or glycerol, G), a foam forming agent (e.g. a gum), and a foam stabilizing agent (e.g. a further gum). The tobacco mousse formulation may in particular comprise propylene glycol, glycerol, purified water, and tobacco powder. The tobacco mousse formulation may optionally comprise additional components, e.g. one or more flavorants.

When the tobacco mousse formulation is heated, the tobacco particles are carried in an aerosol which is then smoked, or inhaled, by a user. The mousse includes air bubbles or pores, which aids heated air to flow there through and consequent aerosol generation by convective heat transfer from the air etc. The tobacco mousse formulation may have fluid-like or semi-solid properties, e.g. characterized by having a dynamic viscosity of between about 10 Pa s and 1000 Pa·s, preferably between about 100 Pa s and 500 Pa·s and most preferably between about 100 Pa s and 300 Pa·s.

The inventors have also found advantageous designs for electronic smoking devices as well as for peripheral devices and methods for supplying the electronic smoking device with a tobacco mousse formulation.

The present invention provides, according to a first aspect, an electronic smoking device comprising a storage portion containing a tobacco mousse formulation, wherein the storage portion is provided with a heating structure configured to heat the received tobacco mousse formulation within the storage portion.

The invention provides, according to a second aspect, also a dispenser comprising a container portion containing a tobacco mousse formulation and a dispensing member configured to dispense the tobacco mousse formulation from the container portion.

The invention further provides, according to a third aspect, a smoking system comprising an electronic smoking device having an access port configured to receive a tobacco mousse formulation into the electronic smoking device, wherein the access port is configured to guide the tobacco mousse formulation received by the access port into a storage portion of the electronic smoking device. The storage portion is provided with a heating structure configured to heat the received tobacco mousse formulation (within the storage portion. The smoking system further comprises a dispenser according to the second aspect of the invention. The dispenser is adapted to dispense the tobacco mousse formulation into the access port of the electronic smoking device.

The electronic smoking device of the smoking system is preferably an electronic smoking device according to the first aspect of the invention.

The invention additionally provides, according to a fourth aspect, a method of supplying a tobacco mousse formulation to a storage portion of an electronic smoking device or to a storage portion for use in an electronic smoking device, the method comprising dispensing the tobacco mousse formulation into said storage portion.

The invention also provides, according to a fifth aspect, a use of a dispenser according to the second aspect for supplying a tobacco mousse formulation to an electronic smoking device, particularly to an electronic smoking device according to an embodiment of the first aspect, or for supplying a tobacco mousse formulation to a storage portion for use in an electronic smoking device, particularly to an electronic smoking device according to an embodiment of the first aspect.

The invention further provides, according to a sixth aspect, a use of a tobacco mousse formulation for, or with, the dispenser according to the second aspect.

The invention also provides, according to a seventh aspect, a tobacco mousse formulation suitable for use with any of the preceding aspects. The tobacco mousse formulation preferably comprises a tobacco ingredient containing agent (e.g. tobacco particles), an aerosol forming agent (e.g. propylene glycol, PG, or glycerol, G or a combination of PG and G), a foam forming agent (e.g. a gum), and a foam stabilizing agent (e.g. a further gum), wherein the aerosol forming agent comprises 20-70, and most preferably about 40, percent of the weight of the mousse formulation and the water level is less than 3% by weight and wherein, during the production of the mousse, after adding the aerosol forming agent, the percentage by weight of water is maintained at less than 5%.

Preferably, the mousse is formed, and cured after formation, such that the viscosity of the mousse is sufficiently low, or equivalently the fluidity of the mousse is sufficiently high, as to enable the mousse to be dispensed by squeezing it out of a tube through an orifice. Such viscosities fall within a range of between about 10 Pa·s to 1000 Pa·s, preferably between 100 Pa·s and 500 Pa·s and most preferably between 100 Pa·s and 300 Pa·s.

It is also preferred that in the use of the dispenser according to the fifth aspect, and in the use of a tobacco mousse according to the sixth aspect, a tobacco mousse formulation according to the seventh aspect is used.

In the following, advantages and advantageous embodiments of the above aspects of the invention will be described in more detail.

Electronic Smoking Device

The electronic smoking device according to the first aspect has the advantage that a user may simply dispense the tobacco mousse formulation from a dispenser (preferably a dispenser according to the second aspect) into the electronic smoking device without the need for any capsules, cartridges and the like. In this way, waste is reduced. Additionally, the user may have more freedom regarding dosage and content of the tobacco mousse Because of the heating structure, the storage portion of the electronic smoking device may also serve as an oven, it may therefore also be designated as an oven, or as an oven portion. Preferably, the heating structure is configured to heat but not burn the received tobacco mousse formulation. In other words, the tobacco mousse formulation may be heated within the storage portion without combustion of the tobacco mousse formulation.

The electronic smoking device may thus be provided with an access port configured to receive a dispensing member for dispensing a tobacco mousse formulation into the electronic smoking device. The access port may be formed such as to guide the received dispensing member, e.g. by being geometrically adapted to the shape of the dispensing member.

Alternatively, the electronic smoking device may be configured to receive a pod, a tray or a capsule containing (or carrying) the tobacco mousse formulation. In this way, supplying the tobacco mousse formulation to the electronic smoking device may be rendered easier and cleaner. The electronic smoking device may comprise an access port formed to receive the pod, the tray or the capsule containing the tobacco mousse formulation. Such a pod may advantageously be formed out of a paper which does not burn unless exposed to temperatures significantly in excess of the temperature(s) to which the electronic smoking device is configured to be heated. Such a paper may advantageously be porous to air and vapour whilst being substantially impermeable to the mousse formulation.

In some advantageous embodiments, the access port is configured to guide the tobacco mousse formulation received by the access port into a storage portion of the electronic smoking device, preferably directly into the storage portion. Thus, the tobacco mousse formulation may be guided to its intended destination within the electronic smoking device simply by being dispensed into the access port so that, e.g., pumps or the like may be unnecessary. In a simple variant, the access port may open directly onto the storage portion of the electronic smoking device.

In some advantageous embodiments, the electronic smoking device comprises a communication unit configured to receive an external activation signal or signal response, and a controller configured to control an opening and/or closing of the access port based on the received external activation signal or signal response. Controlling the opening and/or closing of the access port may comprise physically opening or closing a cover member of the access port and/or releasing or locking a fastener or a lock of the access port. In other words, opening/closing the access port may comprise, or mean, granting/denying access to the storage portion via the access port. In this way, it may be ensured that the access port is only opened for a certified dispenser that is able to send the correct external activation signal or signal response. For example, the communication unit may comprise, or consist of, a radio-frequency identification (RFID) reader configured to read a RFID tag attached to a dispenser for the tobacco mousse formulation.

Radio-frequency identification (RFID) uses electromagnetic fields to automatically identify and track tags attached to objects, e.g. the dispenser. The tags contain electronically stored information. Passive tags collect energy from a nearby RFID reader's interrogating radio waves. Active tags have a local power source (such as a battery) and may operate at comparatively larger distances from the RFID reader.

Preferably, the RFID tag of the dispenser is configured to transmit, or to be readable, to the communication unit's RFID reader only when the RFID tag of the dispenser is closer to the RFID reader than 1 meter, more preferably closer than 0.5 meters, even more preferably closer than 0.25 meters, still more preferably closer than 0.05 meters (5 centimeters).

One idea behind this is that the dispenser will have to be brought into close proximity of the electronic smoking device in any case to dispense the tobacco mousse formulation into the electronic smoking device. Making an opening and/or closing of the access port dependent on the received external activation signal or signal response may thus help to restrict opening and/or closing of the access port to those situations in which the user purposely wants to open/close the access port and thus minimize any risk of accidental opening in particular.

Another purpose behind these embodiments is that the electronic smoking device may be configured towards use with a particular dispenser, or a particular type of dispenser, and vice versa. An electronic smoking device could be configured such that its controller is configured to open its access port only when a dispenser of a certain type is brought into close proximity, and configured to keep the access port closed when no such dispenser is brought into close proximity. For example, the sale of dispenser with a certain type of tobacco mousse formulation may be restricted to certain persons as may be the sale of the corresponding electronic smoking device.

The embodiments described above may thus help to prevent an unauthorized user from using said certain type of tobacco mousse formulation with the user's electronic smoking device. Further, the above embodiments may help to prevent a user from accidentally using an unsuitable tobacco mousse formulation (or any other unsuitable substance) with a specific electronic smoking device. For example, an electronic cigarette (as one type of electronic smoking device) could be provided with a controller configured to keep the access port of the electronic cigarette closed when only a dispenser carrying a tobacco mousse formulation intended for an electronic pipe is brought into proximity with the electronic cigarette.

Dispenser

The dispenser according to the second aspect has the advantage that a user may conveniently, safely and cleanly dispense the tobacco mousse formulation into an electronic smoking device, in particular into an electronic smoking device according to the first aspect, or into a pod, a tray or a capsule for use in an electronic smoking device.

In some advantageous embodiments, the dispenser comprises an actuator and is configured to dispense a specific amount of the tobacco mousse formulation when the actuator is operated. Operating of the actuator by a user may specifically comprise exerting pressure onto the actuator. The specific amount may be fixed, or the dispenser may be configured such that the amount to be dispensed may be adjusted or set.

For example, the actuator may consist of, or comprise, a button, a slider, a turning knob and/or the like. The dispenser may comprise, e.g., a dispensing chamber having a volume corresponding to the specific amount of the tobacco mousse formulation. The dispenser may be configured such that, whenever the actuator is actuated, the dispensing chamber is completely filled with the tobacco mousse formulation from a tobacco mousse formulation reservoir of the dispenser, and, upon release of the actuator, the amount of tobacco mousse formulation within the dispensing chamber (and only that amount) is dispensed from the dispenser. In a simple variant, the dispenser may be realized as a syringe with a piston, or plunger, that is only movable, or extendable, along a predetermined displacement length each time the piston, or plunger, is operated by a user.

The dispenser may be configured such that it dispenses the specific amount as often and as soon as the actuator is operated (or, in other words, actuated) by a user, provided that enough of the tobacco mousse formulation is left in the dispenser. The dispenser may be provided with an indicator structure that is configured to indicate to the user that the dispenser is depleted and no longer able to dispense the specific amount of the tobacco mousse formulation. The indicator structure may be configured to render the dispenser permanently inoperable, i.e. unable to dispense additional tobacco mousse formulation, when the indicator structure indicates the dispenser to be depleted.

In some advantageous embodiments, the dispenser comprises a setting structure for setting the specific amount of the tobacco mousse formulation to be dispensed. The setting structure may be a purely mechanical structure. For example, the setting structure may comprise a knob that the user may turn which results in a volume of a dispensing chamber of the dispenser being made larger or smaller. The setting structure may also comprise electronic components such that a controller of the dispenser is able to digitally set the specific amount of the tobacco mousse formulation to be dispensed.

In some advantageous embodiments, the dispenser comprises a communication interface configured to receive an information signal from outside of the dispenser, and wherein the setting structure is configured to set the specific amount of the tobacco mousse formulation based on the received information signal. Preferably, the communication interface is configured to receive the information signal from an electronic smoking device, in particular an electronic smoking device according to the first aspect.

As has been described in the foregoing, a communication between the electronic smoking device and the dispenser may be realized by RFID communication, wherein a communication range of the RFID communication is set to a distance smaller than 1 meter, more preferably smaller than 0.5 meters, even more preferably smaller than 0.25 meters, still more preferably smaller than 0.05 meters (5 centimeters). The dispenser may be configured to react only to information signals that carry a specific identifier code, e.g. a unique identifier code unique to one specific electronic smoking device or to one specific type of electronic smoking devices.

The container portion may be monolithically integrated into the dispenser but does not have to be monolithically integrated into the dispenser. Rather, in some advantageous embodiments, the dispenser is configured to receive a removable and replaceable container portion, such as a cartridge or a pouch, comprising the tobacco mousse formulation, and to dispense the tobacco mousse formulation from the received container portion. Thus, a user may obtain a container portion with a comparatively large amount of the tobacco mousse formulation and then be able to dispense desired amounts of said tobacco mousse formulation to, or into, an electronic smoking device. Combined with the above-described features regarding the dispensing of a specific amount of the tobacco mousse formulation by the dispenser, the user may be able to use a single container portion of tobacco mousse formulation for multiple electronic smoking devices requiring different specific amounts of the tobacco mousse formulation to function, or to select a specific amount of tobacco mousse formulation to be dispensed from the container portion depending on the present mood or needs of the user.

In some advantageous embodiments, the container portion comprises, or consists of, a variable volume container storing the tobacco mousse formulation to be dispensed, preferably an airtight variable volume container. Said variable volume container may, for example, be a pouch, a blister e.g. as known from pharmaceutical packaging, or a bag. In a simple yet preferred variant, the dispenser may comprise, or consist of, a variable volume container in the form of a squeezable tube or a syringe containing the tobacco mousse formulation.

A tube is a soft squeezable container which can be used for thick liquids such as adhesive, caulking, ointment, and toothpaste. Basically, a tube is a hollow, often essentially cylindrical, piece with a round or oval profile, made of plastic, paperboard, or aluminum. Both ends of the tube are treated differently during the manufacturing process and filling. In general, on one end of the tube body there is a round orifice, which can be closed by different caps and closures. The orifice can be shaped in many different ways, for example as a dispensing member such as a nozzle, a shaft or needle and/or comprising a docking interface for docking to an electronic smoking device and/or to a storage portion for use in an electronic smoking device.

To attach caps and closures, a thread may be tapped onto a part of the orifice. Furthermore, the tube may be produced such that the other open end is folded several times after the tobacco mousse formulation has been added. The tube is thus hermetically sealed and may be germ-free due to e.g. high temperatures during the production process. Furthermore, it is possible to coat the inside of the tube with special coatings to prevent the material from reacting with the contents.

A tube as a general form for the dispenser is advantageous since the user can easily and intuitively operate (i.e. squeeze) the tube to dispense the tobacco mousse formulation. What is more, the user may easily select an amount of tobacco mousse formulation to be dispensed and may even dispense the tobacco mousse formulation in a gradual, or incremental, or stepwise manner to make sure that the amount of tobacco mousse formulation dispensed is not overly large.

In some advantageous embodiments, an internal lining of a container portion of the dispenser, in particular of a variable volume container of the dispenser, comprises a water barrier layer. It has been found that tobacco mousse formulations in general will absorb moisture from the surrounding atmosphere which may break the structure of the tobacco mousse formulation, e.g. turn the mousse into a slush or may simply reduce the qualities of the inhalable aerosol formed by heating—e.g. adding a perceived harshness or bitterness to the inhalable aerosol or giving rise to a perceived excessive temperature of the vapour giving a burning sensation, etc. The water barrier layer helps to maintain the chemical and/or physical structure of the tobacco mousse formulation within the variable volume container. This is especially the case when the tobacco mousse formulation comprises propylene glycol (PG) and/or glycerin (G).

Preferably, the container portion of the dispenser is configured such that a water uptake of more than 5 wt. %, based on the weight of the tobacco mousse formulation, over a period of 6 months from the outside of the container portion of the dispenser to the inside of the container portion, is prevented in at least 90% of inhabited locations on earth, more preferably in at least 90% of locations on earth.

Advantageously, the water barrier layer comprises, or consists of, an aluminium laminate layer. Such a layer is particularly effective at keeping moisture out of the tobacco mousse formulation.

Apart from the internal lining, the container portion, in particular the variable volume container, may comprise, or consist of, low-density polyethylene (LDPE), polypropylene (PP) and/or any other plastic material. LDPE is a thermoplastic made from the monomer ethylene and is defined by a density range of 0.910-0.940 g/cm$^3$. PP, which is also known as polypropene, is a thermoplastic polymer used in a wide variety of applications.

The tube may be configured to be squeezed, or rolled up, in order to transport the tobacco mousse formulation from the inside of the tube to the outside. The tube may also be provided with an output mechanism configured to push, or deliver, an amount of the tobacco mousse formulation out of the tube.

The dispenser may be provided with an end cap for sealing a dispensing member of the dispenser, e.g. a screw-on end cap for screwing onto a nozzle, or needle, of the dispenser. The end-cap may be provided with a child use prevention mechanism such as a child-proof lock.

Smoking System

The smoking system according to the third aspect has the advantage that a user may conveniently supply the electronic smoking device according to the first aspect using the dispenser according to the second aspect.

The dispenser of the smoking system may comprise a dispensing member for dispensing the tobacco mousse formulation, and the access port of the electronic smoking device and the dispensing member of the dispenser may be configured such that the dispensing member is at least partially insertable into the access port and/or such that the access port is at least partially insertable into the dispensing member. This reduces or eliminates spilling of the tobacco mousse formulation during dispensing.

In some advantageous embodiments of the smoking system, the dispensing member of the dispenser comprises a first docking interface and the access port of the electronic smoking device comprises a second docking interface, wherein the first and the second docking interface are configured to be detachably dockable to one another.

The electronic smoking device and the dispenser may each comprise a docking interface for docking with each other. In this way, the tobacco mousse formulation may be guided from the dispenser to the electronic smoking device without any spillage or leakage. Example docking interfaces include a screw fit docking interface, a bayoneted docking interface, a press fit docking interface and the like.

Method of Supplying a Tobacco Mousse Formulation to a Storage Portion of an Electronic Smoking Device The method according to the fourth aspect has the advantage of providing an easy and clean way for a user to supply the electronic smoking device with a tobacco mousse formulation, in particular to supply an electronic smoking device according to the first aspect using a dispenser according to the second aspect. In some advantageous embodiments of the method, the tobacco mousse formulation may be supplied preferably directly into a storage portion of the electronic smoking device.

In some advantageous embodiments, the method may comprise a step of applying a force to a container portion of the dispenser to effect transmission of the tobacco mousse formulation from the container portion to the electronic smoking device.

In some advantageous embodiments, the method may comprise the steps of:

retaining the dispensed tobacco mousse formulation in a storage portion of the electronic smoking device; and heating the dispensed tobacco mousse formulation within the storage portion wherein it is retained.

A method comprising the above steps may also be designated as a method for operating an electronic smoking device.

In some advantageous embodiments, the method may comprise the step of docking a docking interface of a dispenser according to an embodiment of the second aspect with a docking interface of an electronic smoking device according to an embodiment of the first aspect.

Uses

The use according to fifth aspect has the advantage of providing an easy and clean way for a user to supply the electronic smoking device with a tobacco mousse formulation, in particular to supply an electronic smoking device according to the first aspect with a tobacco mousse formulation.

Tobacco Mousse Formulation

The mousse formulation according to the seventh aspect of the present invention has the advantage of providing an aerosol forming substrate in a convenient form which can be conveniently packaged in a hermetically sealed container and conveniently dispensed in appropriate portions by a user directly into an appropriate smoking device without the user having to touch the substance and without exposing a substantial amount of the remainder of the mousse in the dispenser to the atmosphere.

BRIEF DESCRIPTION OF THE DRAWINGS

The invention will be explained in greater detail with reference to exemplary embodiments depicted in the drawings as appended.

The accompanying drawings are included to provide a further understanding of the present invention and are incorporated in and constitute a part of this specification. The drawings illustrate the embodiments of the present invention and together with the description serve to explain the principles of the invention. Other embodiments of the present invention and many of the intended advantages of the present invention will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Although specific embodiments have been illustrated and described herein, it will be appreciated by those of ordinary skill in the art that a variety of alternate and/or equivalent implementations may be substituted for the specific embodiments shown and described without departing from the scope of the present invention. Generally, this application is intended to cover any adaptations or variations of the specific embodiments discussed herein.

Figure 1:
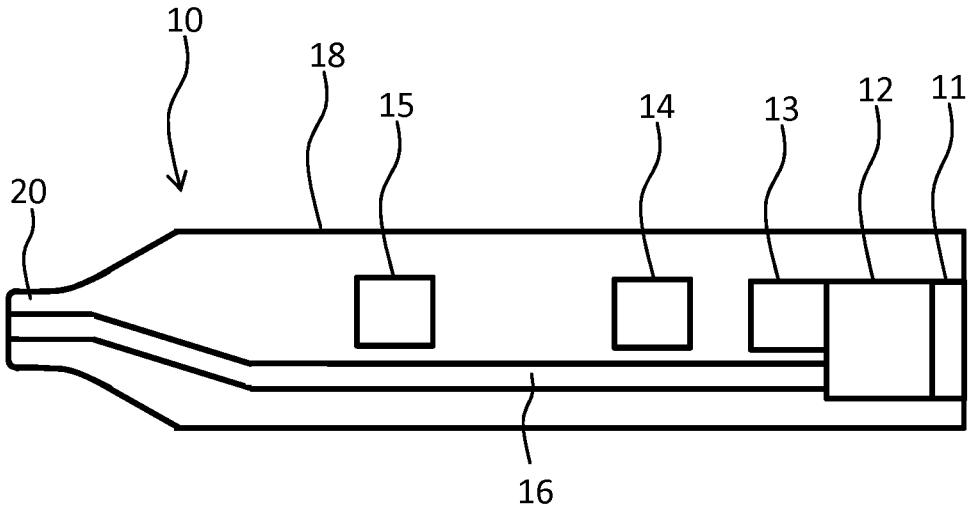
FIG. 1 schematically illustrates an electronic smoking device according to an embodiment of the first aspect of the present invention.

FIG. 1 shows a schematic illustration of an electronic smoking device 10 according to an embodiment of the first aspect of the present invention. As it is illustrated in FIG. 1, the electronic smoking device 10 may, specifically, be an electronic cigarette. The electronic smoking device 10 comprises a housing 18 in which a storage portion 12 is provided.

An access port 11 is provided in the housing 18. The access port 11 is configured to receive a dispensing member for dispensing a tobacco mousse formulation into the electronic smoking device.

In a simple variant, the access port 11 may comprise, or consist of, an opening in the housing 18 together with a cover member, e.g. a hinged lid, for opening and closing the opening. Such a cover member may be provided with a fastener that may be fastened and released by a user of the electronic smoking device 10 when the user wants to supply the electronic smoking device 10 with the tobacco mousse formulation. The opening may be positioned at an axial end of a generally longitudinal or elongated housing 18, or it may be formed in a lateral, or circumferential, wall of the housing 18.

Alternatively, the access port 11 may be provided without a cover member and may be configured such that an external or detachable storage portion, e.g. a tray, containing or carrying the tobacco mousse formulation, may be temporarily attached to the access port 11 such that a part of that external storage portion covers the opening in the housing 18. For example, the external or detachable storage portion may be formed as an end cap for the electronic smoking device 10, comprising a screw fit docking interface with which it is screwed into a screw fit docking interface of the access port 11.

The access port 11 may further alternatively be configured to receive an external or detachable storage portion and still comprise a cover member as described above. For example, the external or detachable storage portion may be realized in the form of a tray or a grilled cage that is insertable into the storage portion 12 which the user may then close with the cover member. The grilled cage may be formed of one or more materials that do not melt, or in any other way lose their shape or deteriorate, when exposed to a temperature to which the tobacco mousse formulation is heated within the electronic smoking device 10, as will be described in the following.

In these variants with an external or detachable storage portion, the tobacco mousse formulation can be supplied to the electronic smoking device 10 by temporarily attaching the external or detachable storage portion containing the tobacco mousse formulation to the access port 11. The electronic smoking device 10 in this variant may comprise the housing 18 with the components contained therein, as described in the foregoing and in the following, as well as the detachable storage portion configured to be temporarily attached to the access port 11 of the housing 18.

The opening of the access port 11 may open directly onto the storage portion 12. The user may then simply insert, or deposit, the tobacco mousse formulation through the open cover member into the storage portion 12, for example using a dispensing member of a dispenser as has been discussed in the foregoing or as will be discussed in the following.

The electronic smoking device 10 also comprises a heating structure 13 configured to heat the received tobacco mousse formulation within the storage portion 12. Accordingly, the storage portion 12, or a part of it, may also be designated as an "oven", or an "oven portion". For example, the heating structure 13 may comprise a heating wire that is heated by conducting an electric current through the heating wire. The heating structure 13 may be configured to heat a section of the storage portion 12, for example a wall of the storage portion 12 such that the wall radiates and/or conducts heat to the received tobacco mousse formulation within the storage portion 12. Said wall may e.g. comprise, or consist of, a metal.

The electronic smoking device 10 may comprise a controller 14 configured to control the heating structure 13. It is preferred that the controller 14 is configured to control the heating structure 13 such that the heating structure 13 heats the tobacco mousse formulation without burning it. The heating structure 13 may thus also be designated as a heat-not-burn heating structure 13 and the electronic smoking device 10 may be designated as a heat-not-burn electronic smoking device 10. The heating structure 13 and/or the controller 14 may be configured to heat the tobacco mousse formulation to a temperature of at most 350° C., preferably at most 300° C., further preferably below 300° C. Most preferably the heater is configured to heat the tobacco mousse formulation to a temperature below 250° C. and in particular to heat a mousse formulation in accordance with the sixth aspect to a temperature between 240° C. and 250° C., preferably to a temperature of 245° C.

It has been found that at these temperatures and/or temperature ranges a tobacco ingredient containing agent and/or an inhalable agent of the tobacco mousse formulation are "extracted" during heating thereof, so that a flavor from the tobacco ingredient containing agent and/or the inhalable agent is released thereof together with an aerosol forming agent of the tobacco mousse formulation with negligible amounts of aerosol components derived from pyrolysis or combustion being formed.

For controlling the heating structure 13, and thus the temperature of the tobacco mousse formulation, the heating structure 13 may comprise at least one temperature sensor, e.g. an electrical-resistance-based temperature sensor, for measuring a temperature of the tobacco mousse formulation and/or a temperature of or within the storage portion 12, such that the controller 14 may control the heating structure 13 based on the temperature measured by said at least one temperature sensor. The temperature may be measured directly or indirectly, e.g. by measuring an electrical resistance, a deformation of a bimetallic instrument and so on.

The controller 14 may control the heating structure 13 based on additional signals and/or information. For example, the controller 14 may activate the heating structure 13 when the electronic smoking device 10 itself is activated by a user and may deactivate the heating structure 13 when the electronic smoking device 10 is deactivated by a user or automatically deactivated, e.g. due to lack of activity over a predetermined time period. The controller 14 may specifically be implemented as, or using, a microcontroller, an ASIC, an FPGA and so on, optionally in combination with a non-volatile memory for storing a software and/or firmware which the controller 14 executes.

The controller 14 may additionally vary the heating during a smoking session. For example, the controller 14 may apply a predetermined heating profile by which, for example, an initial high energy is supplied to the heating structure 13 to get the oven portion quickly to an operating temperature and then to supply enough energy to maintain the oven portion at a consistent temperature. Alternatively, the controller 14 may supply sufficient energy to keep the oven portion at a target temperature which may vary during the smoking session—e.g. following a slightly decreasing target temperature over time as the amount of aerosol forming agent contained within the mousse portion in the oven portion reduces as a result of it being vaporized and consumed by the user. As another alternative, an increasing target temperature profile might be applied.

Similarly, the target temperature could be selected as a "ready" temperature (e.g. 230° C.) somewhat below the optimum temperature for aerosol generation, with a button, or sensor (e.g. a puff sensor or a movement sensor etc.) for detecting when the user is about to take a puff at which point the controller 14 controls the heating structure 13 to heat the oven portion to the optimum aerosol generation temperature (e.g. 245° C.) for the duration of the button press, or for an estimated duration of the puff determined via a sensor (e.g. a puff sensor) or for a certain time duration—e.g. 5 seconds after detecting movement of the device if a movement sensor is used, etc.

Preferably, the electronic smoking device 10 comprises a battery 15 that is configured to provide electrical energy to the controller 14 and to the heating structure 13.

The electronic smoking device 10 further comprises an aerosol conducting network 16 which fluidically connects the storage portion 12 to a mouthpiece 20 of the electronic smoking device 10 such that a user of the electronic smoking device 10 is able to inhale the aerosol by sucking on the mouthpiece 20. The aerosol conducting network 16 comprises tubing and optionally additional elements for controlling and/or guiding the flow of the aerosol from the storage portion 12 to the mouthpiece 20 such as filters, pumps, valves and the like.

Figure 2:
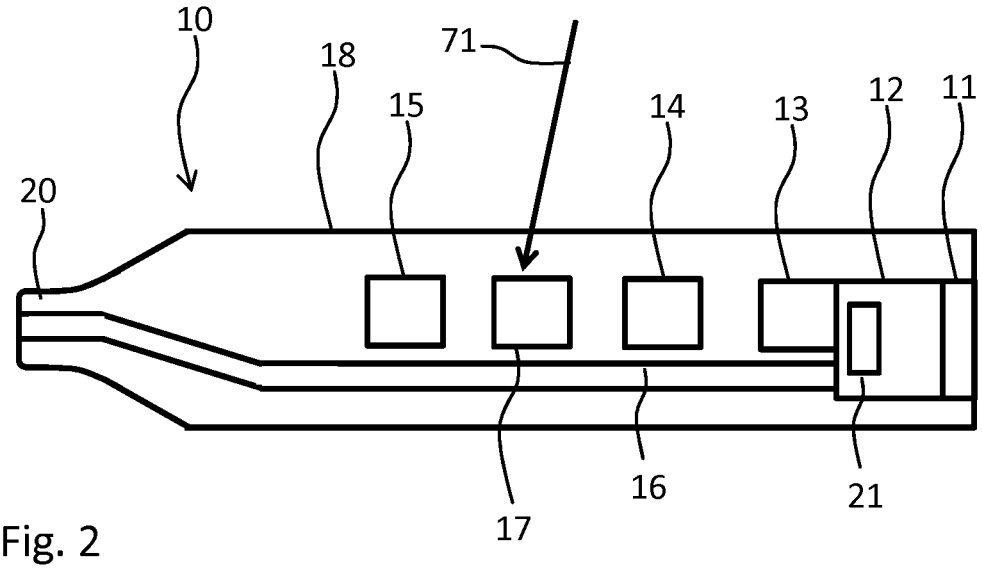
FIG. 2 schematically illustrates an electronic smoking device according to another embodiment of the first aspect of the present invention.

FIG. 2 shows a schematic illustration of an electronic smoking device 10 according to another embodiment of the first aspect of the present invention.

The electronic smoking device 10 illustrated with respect to FIG. 2 comprises an optional communication unit 17 configured to receive an external activation signal 71 and/or a signal response. The access port 11 may comprise an electrically actuatable fastener that is controllable by the controller 14 to fasten or release the cover member of the access port 11, in particular based on the received external activation signal 71. Optionally, the access port 11 may additionally comprise an electrically actuatable opener that is controllable by the controller 14 to open or close the cover member of the access port 11, in particular based on the received external activation signal 71.

For example, the communication unit 17 may comprise, or consist of, a radio-frequency identification (RFID) reader configured to read a RFID tag attached to a dispenser for the tobacco mousse formulation, as has been described in the foregoing.

Specifically, the controller 14 may be configured to open the access port 11, or to allow access to the access port 11, only when an external activation signal 71 of a specific type is received, e.g. an external activation signal 71 comprising an authentication code segment.

FIG. 2 also illustrates that the electronic smoking device 10 may comprise an optional mousse molding structure 21. The mousse molding structure 21 is configured to be movable between a first state, or position, in which the mousse molding structure 21 occupies a certain amount of space within the storage portion 12 and a second state, or position, in which the mousse molding structure 21 occupies less, or no space, within the storage portion 12.

The reason for this lies in the foamy structure, or foam-like properties, of the tobacco mousse formulation. It has been found that the desired agents to be released from the tobacco mousse formulation are released more easily and in greater quantity when the tobacco mousse formulation in the storage portion 12 has a larger surface area. In particular when the tobacco mousse formulation is created such that it essentially, or completely, maintains its form when it is heated to a specific temperature by the heating structure 13, it is advantageous when the tobacco mousse formulation is arranged in a three-dimensional shape with a large surface area compared to its volume.

When, for example, the tobacco mousse formulation is dispensed from e.g. a tube as one type of a dispenser, the tobacco mousse formulation may be originally arranged in a cylindrical or even a spherical shape within the storage portion 12, i.e. in shapes that have comparatively low surface area compared to their volume. However, when the tobacco mousse formulation is dispensed into the storage portion 12 while the mousse molding structure 21 is in the first position, and the mousse molding structure 21 is then subsequently brought into the second position, the tobacco mousse formulation may completely, or mostly, retain its previous shape, including any holes left over where the mousse molding structure 21 was present when it was in the first position.

The mousse molding structure 21 may occupy, in the first position, a cylindrical, conical or cuboid volume within the storage portion 12 by being provided with a corresponding three-dimensional shape. The mousse molding structure 21 may then be configured such that it is (at least partially) retractable into the second position from the storage portion 12 along a longitudinal (or another) axis of said cylindrical, conical or cuboid volume. After retracting the mousse molding structure 21 into the second position, then a corresponding cylindrical, conical or cuboid space will be left within the shape of the tobacco mousse formulation, thus advantageously increasing the surface area of the tobacco mousse formulation.

The retracting of the mousse molding structure 21 from the first position into the second position, and analogously the extruding of the mousse molding structure 21 from the second position into the first position, may be coupled to a closing and opening, respectively, of the cover member of the access port 11. In other words, the mousse molding structure 21 may be configured to be extruded into the first position within the storage portion 12 when or while the cover member is being opened, and may be retracted into the second position when or while the cover member is being closed. The coupling between the mousse molding structure 21 and the cover member may be simply mechanical, or may be controlled by the controller 14 controlling actuators of the cover member and the mousse molding structure 21 accordingly.

Figure 3:
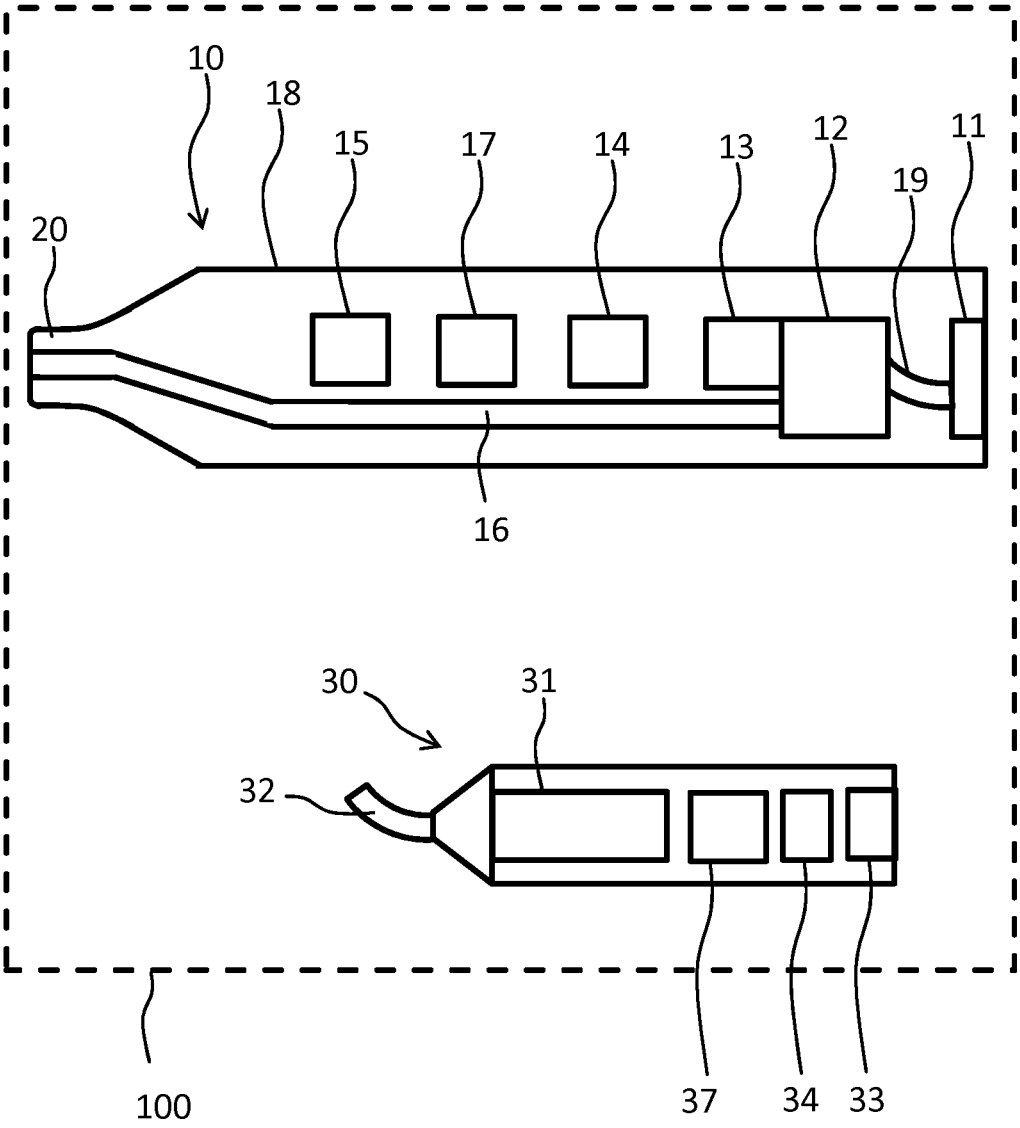
FIG. 3 schematically illustrates a smoking system according to an embodiment of the third aspect of the present invention as well as an electronic smoking device according to still another embodiment of the first aspect of the present invention and a dispenser according to an embodiment of the second aspect of the present invention.

Although both the communication unit 17 and the mousse molding structure 21 have been explained with respect to FIG. 3, it should be understood that these two elements may be provided separately and independently from each other. Moreover, both the communication unit 17 and/or the mousse molding structure 21 may be provided in any of the other embodiments of the first aspect.

FIG. 3 shows a schematic illustration of a smoking system 100 according to an embodiment of the third aspect of the present invention. The system 100 comprises an electronic smoking device 10 according to still another embodiment of the first aspect of the present invention and a dispenser 30 according to an embodiment of the second aspect of the present invention. FIG. 3 also illustrates properties of said electronic smoking device 10 and said dispenser 30 independent of the smoking system 100.

Although in FIG. 3 one particular embodiment of the smoking system 100 is shown, it should be understood that the smoking system 100 may also comprise electronic smoking devices according to other embodiments and/or dispensers 30 according to other embodiments.

The dispenser 30 illustrated in FIG. 3 comprises a container portion 31 for storing the tobacco mousse formulation and a dispensing member 32 for dispensing the tobacco mousse formulation from the container portion 31, specifically into the electronic smoking device 10. The dispensing member 32 may be formed as simple orifice, or may be formed as a member guiding the tobacco mousse formulation outside of the container portion 31, such as a nozzle, a needle, or a hose.

In addition to the opening and the cover member as described in the foregoing, the access port 11 of the electronic smoking device 10 of FIG. 3 also comprises a conduit 19 through which the storage portion 12 is fluidically connected to the opening of the access port 11.

The conduit 19 of the electronic smoking device 10 as illustrated in FIG. 3 may optionally have a distinctive geometrical form e.g. comprising a curvature or bend, e.g. a bend of 30 degrees or more, preferably of 40 degrees or more, even more preferably of 50 degrees or more. In this way, it becomes less likely that unwanted particles or elements enter into the storage portion 12 when the cover member of the access port 11 is open.

When the conduit 19 of the electronic smoking device 10 has said distinctive geometrical form, it is advantageous if the dispensing member 32 of the dispenser 30 is provided with a corresponding geometrical form, as schematically illustrated in FIG. 3. In particular, when the conduit 19 comprises a curvature or bend, the dispensing member 32 may be shaped to have the same, or essentially the same, curvature or bend.

Different types of electronic smoking devices 10 may be provided with conduits 19 of different shape, and different dispensers 30 for those different types of electronic smoking devices 10 with corresponding dispensing members 32 in order to prevent the wrong type of dispenser 30 (i.e. filled with the wrong type of tobacco mousse formulation) being used with the wrong type of electronic smoking device 10. For example, in this way it may be prevented that a tobacco mousse formulation that burns at 320° C. is dispensed into an electronic smoking device 10 with a heating structure 13 that is configured and controlled to heat the tobacco mousse formulation in its storage portion 12 to 350° C.

The conduit 19 may be considered as a docking interface of the electronic smoking device 10, and the corresponding dispensing member 32 may be considered as a docking interface of the dispenser 30. As has been discussed in the foregoing, other types of corresponding docking interfaces may be provided, e.g. screw fit docking interfaces, bayoneted docking interfaces, press fit docking interfaces and so on.

As also shown in FIG. 3, also the electronic smoking device 10 of the smoking system 100 may optionally comprise the communication unit 17 as described in the foregoing. In that case, advantageously the dispenser 30 of the smoking system 100 is provided with a communication interface 37 configured to send the external activating signal 71 to the communication unit 17 of the electronic smoking device 10, or to respond to a query signal of the communication unit 17 with a response signal for the communication unit 17 of the electronic smoking device 10. As described in the foregoing, in this way the use of the wrong dispenser 30 with the wrong electronic smoking device 10 may also be prevented, e.g. by the controller 14 controlling the access port 11 to deny access to the dispenser 30 when the external activating signal 71 or response signal of the communication interface 37 of the dispenser 30 does not comprise the correct code segment.

Specifically, the communication interface 37 may be realized as an RFID tag. Preferably, such an RFID tag of the dispenser 30 is configured to transmit, or to be readable, to the communication unit 17 of the electronic smoking device 10 only when the RFID tag of the dispenser 30 is closer to the communication unit 17 than 1 meter, more preferably closer than 0.5 meters, even more preferably closer than 0.25 meters, still more preferably closer than 0.05 meters (5 centimeters).

Both the specific shape of the conduit 19 and the dispensing member 32 on the one hand and the communication interface 37 and the communication unit 17 on the other hand may be provided, or only one of the two combinations may be provided in a specific smoking system 100. It should be understood that the communication interface 37 of the dispenser 30 as described above may also be provided in any other type of dispenser 30 described herein in the foregoing or in the following.

As has been discussed in the foregoing, the dispenser 30 may be realized as a variable volume container that is squeezable by a user in order to dispense the tobacco mousse formulation from the container portion 31. For example, the dispenser 30 may be realized as a squeezable tube, as a blister, a package, a bag, a pouch or the like, each provided with a dispensing member 32.

The variable volume container preferably comprises an internal lining that includes a water barrier layer, more preferably an aluminium laminate layer. Preferably, a water uptake of more than 5 wt. %, based on the weight of the tobacco mousse formulation, over a period of 6 months from the outside of the container portion 31 of the dispenser 30 to the inside of the container portion 31, is prevented in at least 90% of inhabited locations on earth, more preferably in at least 90% of locations on earth.

Apart from the internal lining, the container portion 31, in particular the variable volume container, may comprise, or consist of, low-density polyethylene (LDPE), polypropylene (PP) and/or any other plastic material.

The dispenser 30 may also comprise an actuator 33, and the dispenser 30 may be configured to dispense a specific amount of the tobacco mousse formulation when the actuator 33 is operated. One particular variant of such a dispenser will later be described with respect to FIG. 4. The dispenser 30 may also comprise a setting structure 34 for setting the specific amount of the tobacco mousse formulation to be dispensed.

The dispenser may comprise, e.g., a dispensing chamber having a volume corresponding to the specific amount of the tobacco mousse formulation. The dispenser 30 may be configured such that, whenever the actuator 33 is actuated, the dispensing chamber is completely filled with the tobacco mousse formulation from the container portion 31 of the dispenser 30, and, upon release of the actuator 33, the amount of tobacco mousse formulation within the dispensing chamber (and only that amount) is dispensed from the dispenser 30. The setting structure 34 may be configured to vary the volume of the dispensing chamber, either mechanically, or by electrically controlling an electric motor.

The setting structure 34 may also be configured to automatically vary the volume of the dispensing chamber, or in any other way vary the amount of tobacco mousse formulation to be dispensed, based on a signal received by the communication interface 37 of the dispenser 30. For example, the communication unit 17 of the electronic smoking device 10 may be configured to send out a code segment indicating a specific optimal amount of tobacco mousse formulation for that specific electronic smoking device 10. The communication interface 37 of the dispenser 30 may receive that signal and set the specific amount to be dispensed accordingly, either with or without prompting a user of the dispenser 30 to confirm that automatic setting.

The container portion 31 may be an integral part of the dispenser 30. Alternatively, the dispenser 30 may be configured to receive a pouch, or a cartridge, as the container portion 31 such that the dispenser 30 can be used multiple times and be refilled whenever the current container portion 31 has been depleted.

The tobacco mousse formulation may be contained loosely within the container portion 31 or may be contained within separate tobacco mousse formulation pods or capsules surrounded by an outer skin or shell that is removed when the tobacco mousse formulation pod or capsule is heated within the storage portion 12. For example, the outer skin or shell may be configured to evaporate or melt at the temperature to which the tobacco mousse formulation is heated within the storage portion 12 or at a temperature below that temperature. The dispenser 30 may be configured to dispense, whenever the actuator 33 is actuated (or, in other words, operated), one single unit of the tobacco mousse formulation pods or capsules.

Figure 4:
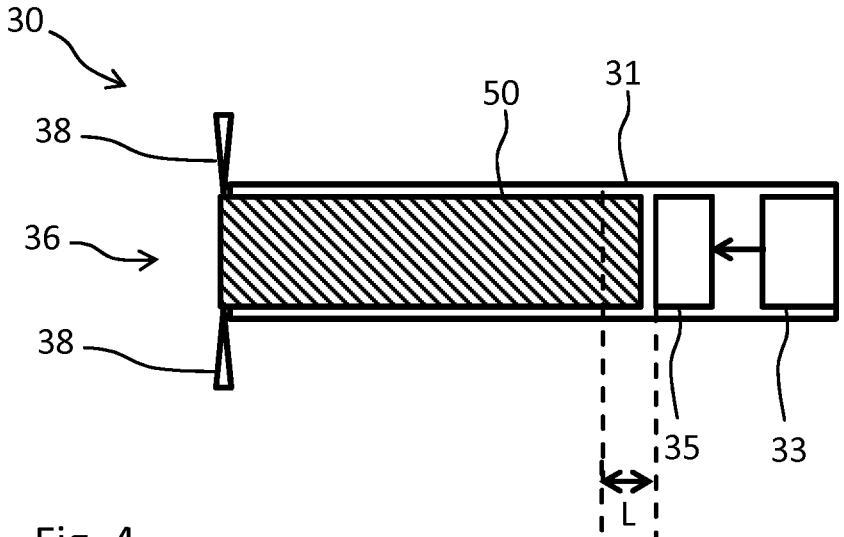
FIG. 4 and FIG. 5 schematically illustrate the function of a dispenser according to another embodiment of the second aspect of the present invention.
Figure 5:
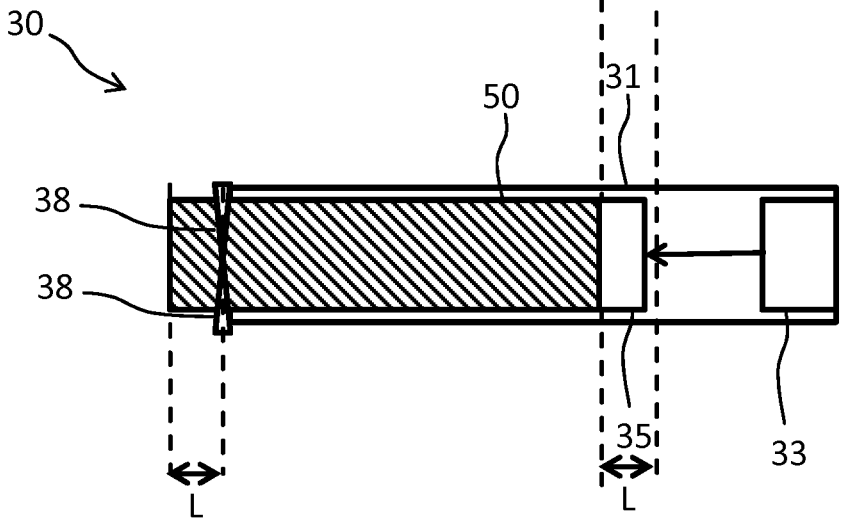

FIG. 4 and FIG. 5 schematically illustrate a dispenser 30 according to another embodiment of the second aspect of the present invention.

As shown in FIG. 4 and FIG. 5, the dispenser 30 may also be realized as follows: the container portion 31 is formed in an elongated shape, e.g. in a cylindrical shape with a round or ovoid cross-section. The container portion 31 contains the tobacco mousse formulation 50. At one end of the container portion 31 a button 33 (as a type of actuator) is provided that a user can push. At the other end of the container portion 31 is an orifice 36 that serves as a dispensing member 32. By pushing the button 33, the user may extrude the tobacco mousse formulation 50 from the orifice 36.

At the orifice 36, a cutting structure 38 may be provided, e.g. in the form of two blades 38 movable towards and away from each other, in the form of one blade movable towards a fixed edge, in the form of an iris or the like. Using the cutting structure 38, a user of the dispenser 30 may sever the extruded mass of the tobacco mousse formulation 50 from the tobacco mousse formulation 50 remaining in the container portion 31 when the user believes that enough tobacco mousse formulation 50 has been extruded (i.e. dispensed). The cutting structure 38 may also serve as a movable cover for the orifice 36 which prevents contact of the tobacco mousse formulation 50 inside the container portion 31 with the atmosphere when the cutting structure 38 is closed.

Advantageously, the button 33 and the cutting structure 38 may be mechanically coupled such that the cutting structure 38 is opened when the button 33 is pushed and such that the cutting structure 38 is closed (i.e. cuts) when the button 33 is released. In this way, pushing the button 33 not only opens the orifice 36 and causes the extrusion (dispensing) of the tobacco mousse formulation 50 through the opened orifice 36, but also causes the severing of the extruded tobacco mousse formulation 50 when the button 33 is released by the user.

Advantageously, a piston 35 is provided within the container portion 31, the piston 35 being moved, with each pushing of the button, 33 permanently towards the orifice 36 by a preset and/or adjustable displacement length L. In the case that the container portion 31 has a permanent cylindrical form, the area of the cross-section of that cylindrical form multiplied by the displacement length L amounts to the specific amount of tobacco mousse formulation 50 that is dispensed each time the button 33 is pushed. A setting structure 34 of the dispenser 30 may therefore be configured to adjust the displacement length L along which the piston 35 is moved with each pushing of the button 33.

FIG. 4 shows a state in which the button 33 has started to be pushed, the piston 35 has started to move along the displacement length L, the cutting structure 38 has already opened, and the tobacco mousse formulation 50 has started to be extruded from the orifice 36.

FIG. 5 shows a state in which the button 33 has been released, the piston 35 has moved along the displacement length L, the tobacco mousse formulation 50 has been extruded for the displacement length L, and the cutting structure 38 has closed and thus severed the extruded tobacco mousse formulation 50 from the tobacco mousse formulation 50 remaining within the container portion 31. The outer surface of the cutting structure 38 may be coated with a non-stick coating such that the extruded tobacco mousse formulation 50 does not stick to the cutting structure 38.

Figure 6:
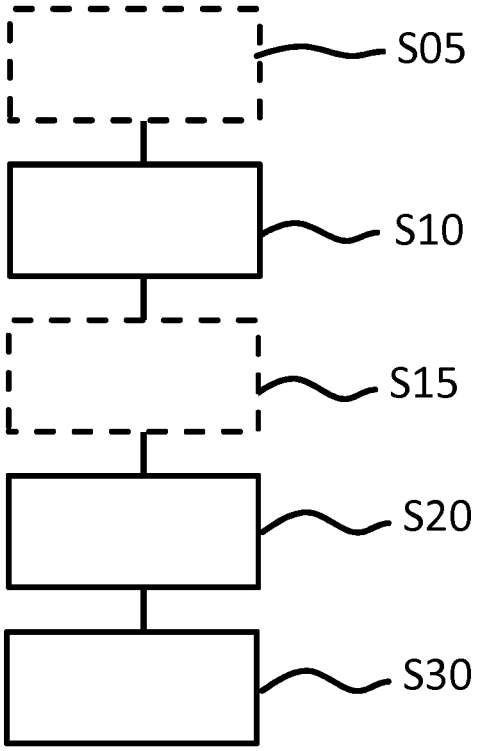
FIG. 6 and FIG. 7 show schematic flow diagrams illustrating methods according to embodiments of the fourth aspect of the present invention.
Figure 7:
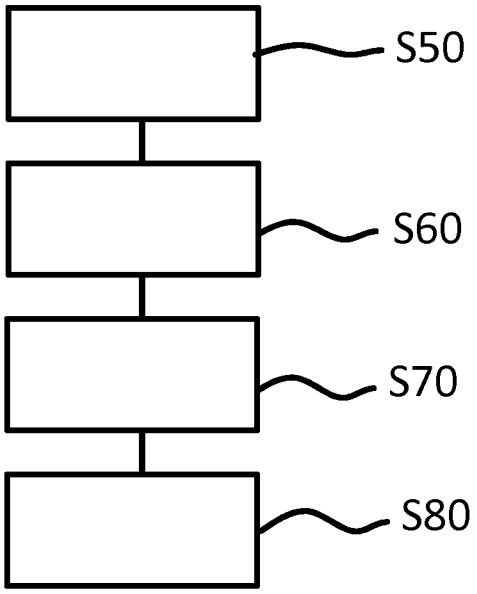

FIG. 6 and FIG. 7 show schematic flow diagrams illustrating methods according to embodiments of the fourth aspect of the present invention. Thus, FIG. 6 illustrates methods of supplying a tobacco mousse formulation to a storage portion of an electronic smoking device or to a storage portion for use in an electronic smoking device.

As has been previously discussed, the methods according to the fourth aspect may be used with any of the electronic smoking devices according to embodiments of the first aspect and/or with any of the dispensers according to embodiments of the second aspect and/or with any of the smoking systems according to embodiments of the third aspect, and may be adapted accordingly, and vice versa. Therefore, when in the following reference signs referring to some of those embodiments are used, it should be understood that the methods according to the fourth aspect are not particularly limited to those embodiments.

Referring now to FIG. 6, in a step S10, a tobacco mousse formulation is dispensed into a storage portion 12 of an electronic smoking device 10, preferably by a dispenser 30 according to an embodiment of the second aspect.

The method may comprise an optional step S05 of docking a docking interface of said dispenser 30 with a docking interface of the electronic smoking device 10 before the tobacco mousse formulation is dispensed from the dispenser 30 into the storage portion 12 of the electronic smoking device 10. The method may also comprise an optional step S15 of terminating the docking of said docking interfaces, preferably before the following step S20.

In a step S20, the dispensed tobacco mousse formulation is retained in the storage portion 12 of the electronic smoking device 10. In a step S30, the tobacco mousse formulation is heated while it is retained in the storage portion 12, e.g. by a heating structure 13 as described in the foregoing. As has been previously described herein, heating the tobacco mousse formulation creates an aerosol comprising a tobacco containing agent such as tobacco particles which a user of the electronic smoking device 10 may then smoke (i.e. inhale).

Referring now to FIG. 7, in a step S50, a tobacco mousse formulation is dispensed into a storage portion for use in an electronic smoking device 10, preferably by a dispenser 30 according to an embodiment of the second aspect. That storage portion may e.g. be a storage portion that is temporarily attachable to (or insertable into), and detachable from, a housing 18 of the electronic smoking device 10. For example, the storage portion may be realized in the form of a tray or a grilled cage.

In a step S60, the storage portion with the tobacco mousse formulation dispensed into it is attached to, or inserted into, the housing 18 of the electronic smoking device 10. In a step S70, the tobacco mousse formulation contained in the storage portion attached to, or inserted into, the housing 18 is heated, e.g. by a heating structure 13 as described in the foregoing. In a step S80, the storage portion is detached, or removed from, the housing 18, in particular after step S70, e.g. when the heating S70 has resulted in all, or almost all, of the tobacco containing agents being released from the tobacco mousse formulation.

In the foregoing detailed description, various features are grouped together in one or more examples or examples with the purpose of streamlining the disclosure. It is to be understood that the above description is intended to be illustrative, and not restrictive. It is intended to cover all alternatives, modifications and equivalents. Many other examples will be apparent to one skilled in the art upon reviewing the above specification.

The embodiments were chosen and described in order to best explain the principles of the invention and its practical applications, to thereby enable others skilled in the art to best utilize the invention and various embodiments with various modifications as are suited to the particular use contemplated. In the appended claims and throughout the specification, the terms "including" and "in which" are used as the plain-English equivalents of the respective terms "comprising" and "wherein," respectively. Furthermore, "a" or "one" does not exclude a plurality in the present case.

The invention claimed is:

1. An electronic smoking device comprising:

a storage portion containing a tobacco mousse formulation, and a mousse molding structure configured to be movable between a first position in which the mousse molding structure occupies a certain amount of space within the storage portion and a second position in which the mousse molding structure occupies less space within the storage portion, wherein the storage portion is provided with a heating structure configured to heat the received tobacco mousse formulation within the storage portion.

2. The electronic smoking device of claim 1, wherein the heating structure is configured to heat the tobacco mousse formulation within the storage portion without combustion of the tobacco mousse formulation.

3. A dispenser comprising:

a container portion containing a tobacco mousse formulation;

a dispensing member configured to dispense the tobacco mousse formulation from the container portion; and an actuator disposed outside of the dispensing member, wherein the dispenser is configured to dispense a specific amount of the tobacco mousse formulation when the actuator is operated.

4. The dispenser of claim 3, wherein the dispenser comprises a setting structure for setting the specific amount of the tobacco mousse formulation to be dispensed.

5. The dispenser of claim 3, wherein the container portion is replaceable.

6. Use of the dispenser according to claim 3 for supplying a tobacco mousse formulation to an electronic smoking device or to a storage portion for use in an electronic smoking device.

7. Use of a tobacco mousse formulation for the dispenser of claim 3.

8. A tobacco mousse formulation suitable for dispensing with the dispenser of claim 3.

9. An electronic smoking device comprising a storage portion containing a tobacco mousse formulation comprising a tobacco ingredient containing agent, an aerosol forming agent, a foam forming agent, and a foam stabilizing agent, wherein the storage portion is provided with a heating structure configured to heat the received tobacco mousse formulation within the storage portion; wherein the tobacco mousse formulation suitable for dispensing with the dispenser of claim 3.

10. The dispenser of claim 3, wherein the container portion comprises, or consists of, a variable volume container.

11. The dispenser of claim 10, wherein an internal lining of the variable volume container comprises a water barrier layer.

12. A smoking system comprising:

an electronic smoking device having an access port configured to receive a tobacco mousse formulation into the electronic smoking device, wherein the access port is configured to guide the tobacco mousse formulation received by the access port into a storage portion of the electronic smoking device; and wherein the storage portion is provided with a heating structure configured to heat the received tobacco mousse formulation within the storage portion; and the dispenser according to claim 3, configured to dispense the tobacco mousse formulation into the access port of the electronic smoking device.

13. The smoking system of claim 12, wherein the access port and the dispensing member are configured such that the dispensing member is at least partially insertable into the access port and/or such that the access port is at least partially insertable into the dispensing member.

14. The smoking system of claim 13, wherein the dispensing member comprises a first docking interface;

wherein the access port comprises a second docking interface; and wherein the first and the second docking interface are configured to be detachably dockable to one another.

15. A method of supplying a tobacco mousse formulation to a storage portion of an electronic smoking device or to a storage portion for use in an electronic smoking device, the method comprising providing the dispenser of claim 3, and dispensing the tobacco mousse formulation into said storage portion by operating the actuator of the dispenser.

16. The method of claim 15, wherein the dispensing of the tobacco mousse formulation comprises:

applying a force to a container portion of the dispenser to effect transmission of the tobacco mousse formulation from the container portion to the electronic smoking device.

* * * * *